US005405264A

United States Patent [19]

Heuss

[11] Patent Number: 5,405,264

[45] Date of Patent: Apr. 11, 1995

[54] DEVICE FOR CARRYING A CHARGE IN A FURNACE

[75] Inventor: Helmut Heuss, Ratingen, Germany

[73] Assignee: Loi Essen Industrieofenanlagen GmbH, Germany

[21] Appl. No.: 134,479

[22] Filed: Oct. 12, 1993

Related U.S. Application Data

[63] Continuation of Ser. No. 872,607, Apr. 23, 1992, abandoned.

[51] Int. Cl.[6] ..... F27D 3/02

[52] U.S. Cl. ..... 432/234; 432/235; 373/109

[58] Field of Search ..... 432/234, 235, 236, 127; 373/109

[56] References Cited

U.S. PATENT DOCUMENTS

| | | | |
|---|---|---|---|
| 3,642,261 | 2/1972 | Laws | 432/234 |
| 4,056,351 | 11/1977 | Knaak | 432/235 |
| 4,290,457 | 9/1981 | Campbell, Jr. | 432/234 |
| 4,386,630 | 6/1983 | Gapinski | 432/234 |
| 4,601,659 | 7/1986 | Webster et al. | 432/234 |
| 4,689,009 | 8/1987 | Heuss | 432/234 |
| 4,886,450 | 12/1989 | Heuss | 432/235 |
| 5,136,610 | 8/1992 | Heuss | 373/109 |

*Primary Examiner*—Henry C. Yuen

*Attorney, Agent, or Firm*—Blakely, Sokoloff, Taylor & Zafman

[57] ABSTRACT

A device for carrying a charge in a reheating furnaces comprising at least one skid pipe through which a cooling fluid flows, the skid pipe having at least one rider provided with at least one surface to support said charge running off center in the longitudinal direction of the skid pipe. According to the invention neighboring surfaces are laterally spaced relative to each other and run at least partially to the side of the skid pipe. Charge exposure to the relatively low temperature around the skid pipe is kept at a very low level and charge temperature is therefore very uniform.

15 Claims, 5 Drawing Sheets

DEVICE FOR CARRYING A CHARGE IN A FURNACE

This is a continuation of application Ser. No. 07/872,607, filed Apr. 23, 1992, abandoned.

BACKGROUND OF THE INVENTION

The present invention relates to a device for carrying a charge and more particularly slabs, billets, ingots and the like in a furnace, said device comprising at least one skid pipe through which a cooling fluid flows and at least two riders fit for service at elevated temperature arranged on said skid pipe and having at least one surface to support said charge running off-center substantially parallel to said skid pipe.

A device of the kind hereinbefore described is known from German Patent No. 34 34 356. Said patent divulges a skid system comprising riders with carrying surfaces located alternately to the left and to the right of the center plane of the skid system to reduce charge skid marks attributable to the charge resting on its support. Such skid marks representing charge areas of relatively low temperature are a distinct disadvantage because they are the cause of quality difficiencies such as differences in thickness and width and texture variations in the rolled product unless said skid marks are removed prior to rolling by relatively complex and costly operations.

Experience has taught that skid marks may be produced not only by the surfaces of riders carrying the charge in a walking beam furnace or the like but also by the skid pipes through which cooling fluid passes thereby creating areas of relatively low temperature. The quality deficiencies associated with said relatively cool areas are becoming increasingly important as specifications of final products become more and more stringent.

THE INVENTION

It is an object of the present invention to improve skid systems of the kind described hereinbefore and to make provision for a very even and uniform temperature distribution in the charge by reasonably simple means which do not have a major impact on production operations.

To provide such means the present invention teaches that neighboring charge carrying surfaces should be laterally spaced relative to each other and run at least partially to the side of the skid pipe.

The riders of which said surfaces form parts are sequentially arranged along the skid pipe, the positions of their carrying surfaces relative to said skid pipe alternating.

The surface areas of said carrying surfaces are minimized for the mass of the charge they are designed to support. As in accordance with the present invention said carrying surfaces are at least partially located to the two sides of said skid pipe off the skid pipe center, skid marks attributable to the relatively cool area around the skid pipe are kept at a relatively low level because the bottom of the charge and above all the part of the charge underside above the center of the skid pipes may be heated directly beyond the centerline represented by the skid pipe from alternating sides as it is exposed for more than half of the charge furnace time.

With respect to such skid marks it is well known that uniform temperature distribution in the charge with substantially no skid marks is important to maintain specified dimensions more accurately in the rolling operation following reheating and to obtain a better quality rolled product.

In a preferred embodiment of the present invention, each face end of each rider is at the side opposite the charge carrying surface provided with a protrusion substantially across half of the width of said face end, the side with said carrying surface thereby being recessed. The rider protrusion hereinbefore described penetrates into the recessed part of the next following rider. The interpenetration of riders alternately exposed to a force rotating to the left and to the right respectively interlocks said riders thereby preventing said riders from being rotated off the skid pipe.

As an alternative in another preferred embodiment of the present invention each rider extends below the top surface of said skid pipe and rests on tilt stopping means firmly connected with said skid pipe underneath its charge carrying surface.

Further in another preferred embodiment of the device proposed by the present invention the rider surface to the side of its charge carrying surface is roof-shaped and said roof-shaped surface is provided with a cutout for the insertion of a ceramic component.

Said component may be made from any ceramic material which enhances the reflection of thermal radiation to increase heat transfer to the bottom surface of the charge.

The roof-shaped configuration of the rider surface of the area adjacent to the rider's charge carrying surface offers the additional advantage of preventing scale build-up.

Said surface may be inclined in the direction of charge travel but is perfectly sloped in the transverse direction because the slope in the transverse direction may be steeper than the slope in the longitudinal direction.

Further, in yet another embodiment of the present invention the rider may be fitted around a fitting on said rider and a bolt is passed through said fitting and through said rider in a direction transverse to the longitudinal extension of the skid pipe. Such a bolted joint is simple and allows easy rider replacement after removal of said bolt by a hammer blow or the like without any cutting or welding operation being necessary.

It is apparent to any skilled person versed in the art that the embodiments of the present invention described hereinbefore may be combined in various ways without altering the substance of the present invention.

BRIEF DESCRIPTION OF THE DRAWINGS

The present invention will now be described with the help of preferred embodiments illustrated in the accompanying drawings.

FIG. 4A is a perspective view of three riders (2, 2*a* and 2*b*), each mounted on the skid pipe (1). Each of these riders (2, 2*a* and 2*b*) comprises the charge carrying surface (4) and the roof-shaped surface (5) wherein the riders (2, 2*a* and 2*b*) are arranged on the skid pipe (1) in an alternating sequence so that a second end of the rider (2) is disposed opposite a first end of the rider (2*a*) and a second end of the rider (2*a*) is disposed opposite a first end of the rider (2*b*).

FIG. 4B is a perspective view of a furnace (15) and a charge (3) longitudinally positioned on a pair of skid pipes (1) identical to that shown in FIG. 4A. The pair of skid pipes (1) support the charge for insertion into the furnace (15).

FIG. 4C is an overhead view of the engagement of two riders (2, 2*a*) capable of withstanding an elevated temperature arranged in such a manner that each rider (2 or 2*a*) includes at least two carrying surfaces (4, 4') or (4*a* and 4*a*') capable of supporting the charge and running off-center and substantially parallel to said centerline in a longitudinal direction. For example, each neighboring carrying surface (4 and 4') of the first rider (2) are laterally spaced relative to each other and are positioned at least partially to a side of the skid pipe. Each rider has two "face" ends which include a recessed first part (13, 13' or 13*a*, 13*a*') on the side of the carrying surface (4, 4' or 4*a*, 4*a*') and a second part (14, 14' or 14*a*, 14*a*'). As shown, the second part (14 and 14*a*') of the two riders (2 and 2*a*) protrudes relative to the neighboring first part (13 and 13*a*') and is opposite to some of the first parts (13*a*' and 13).

DETAILED DESCRIPTION OF THE PRESENT INVENTION

Figure 2:
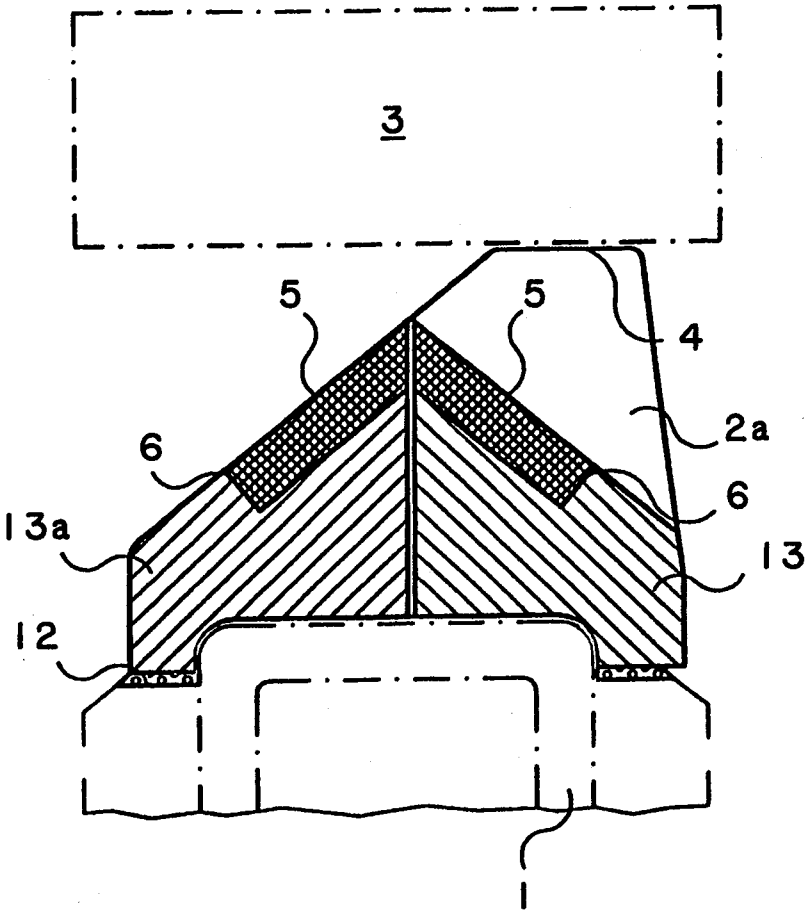
FIG. 2 shows another embodiment of the present invention along line I—I in FIG. 3
Figure 1:
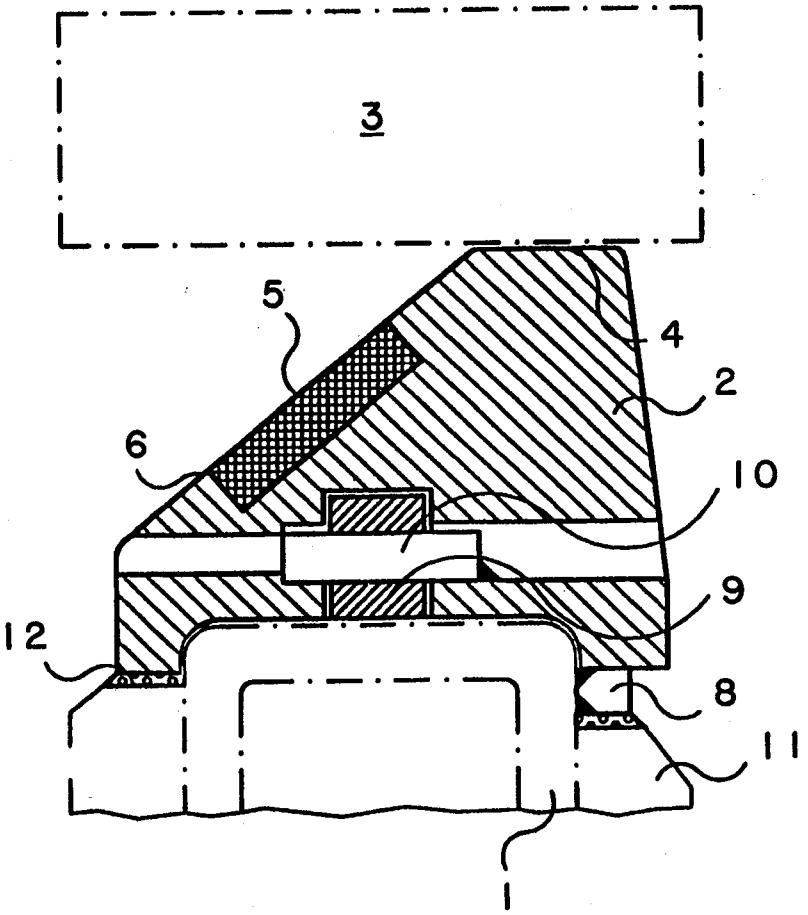
FIG. 1 shows a cross section of an embodiment of the present invention

Referring first to FIG. 1 and FIG. 2, the embodiment of the present invention shown therein comprises a skid pipe (1) running in the longitudinal direction of a furnace. A cooling fluid which may be water or steam flows through said skid pipe for skid pipe cooling.

Said skid pipe (1) is provided with a multiplicity of riders (2) to carry the charge (3), each such rider (2) has a charge carrying surface (4) on which said charge (3) rests. Said charge carrying surface (4) runs partially to one side of said skid pipe. Riders (2) are arranged on said skid pipe in alternating sequence to displace the charge carrying surfaces (4) of two neighboring riders relative to each other thereby allowing the charge bottom and more particularly the charge bottom area over the center of said skid pipe to be heated directly beyond the charge centerline from alternating sides for more than half of the charge furnace time.

To the side of said charge carrying surface (4), a surface (5) of the rider (2) is roof-shaped with a lateral slope to allow any scale to fall down said slope. Said surface (5) is provided with a cut-out (6) filled by ceramic material which protects the rider made from cast material for elevated temperature surface against overheating and enhances heat transfer to the charge bottom by reflecting thermal radiation.

In the embodiment of the present invention depicted in FIG. 1, strip-type built stopper means (8) welded to skid pipe (1) are provided below the charge carrying surface (4) of the rider (2).

Said rider (2) fits around a fitting (9) on said skid pipe (1). A bolt (10) passes through said fitting (9) and said rider (2) in a direction transverse to the longitudinal direction of said skid pipe (1) and is fastened by tack-welding. If necessary, said bolt (10) may be removed easily by a blow allowing the easy removal of riser (2).

Said rider (2) extends around the upper part of the cooled skid pipe (1) approaching the skid pipe insulation system (11), the gap (12) between said skid pipe insulation system (11) and the rider (2) being filled with ceramic fiber material.

Figure 3:
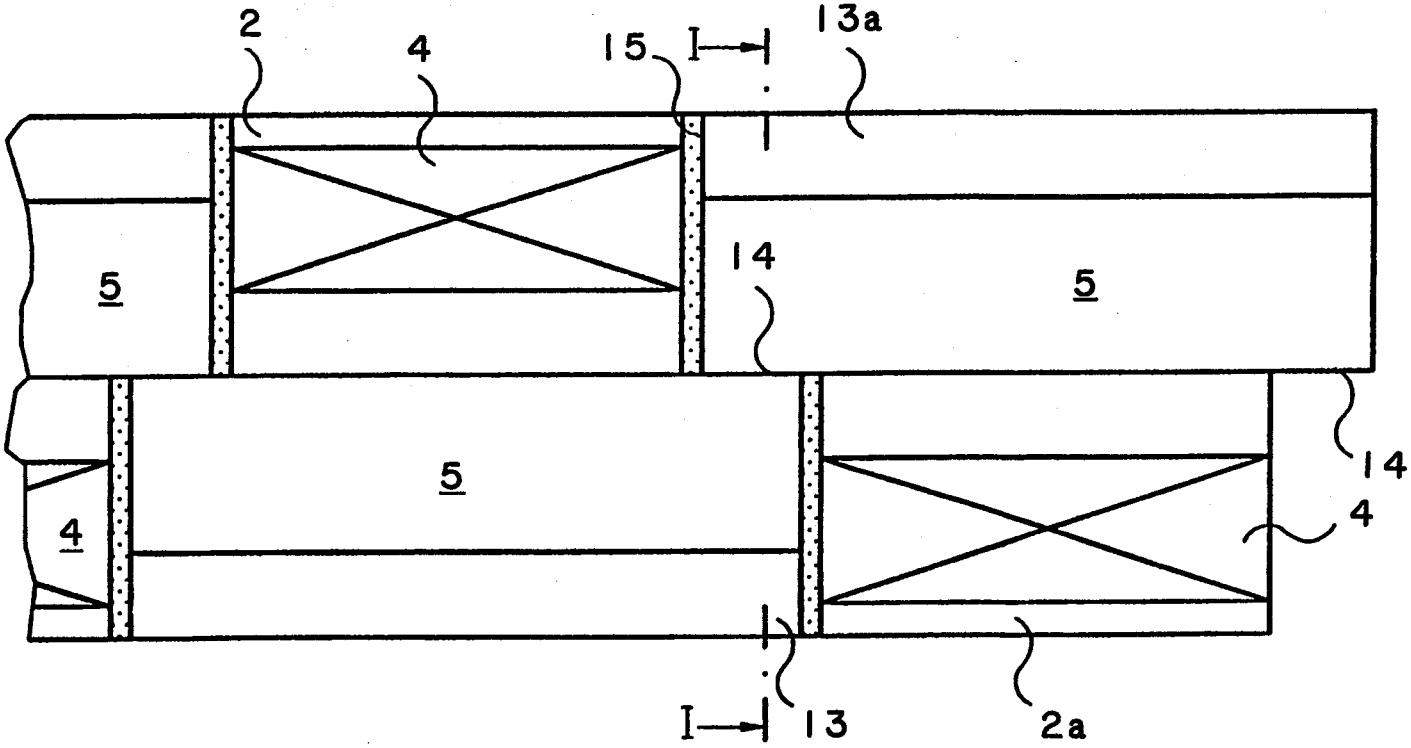
FIG. 3 is a partial top view of the embodiment of the present invention shown in FIG. 2
Figure 4A:
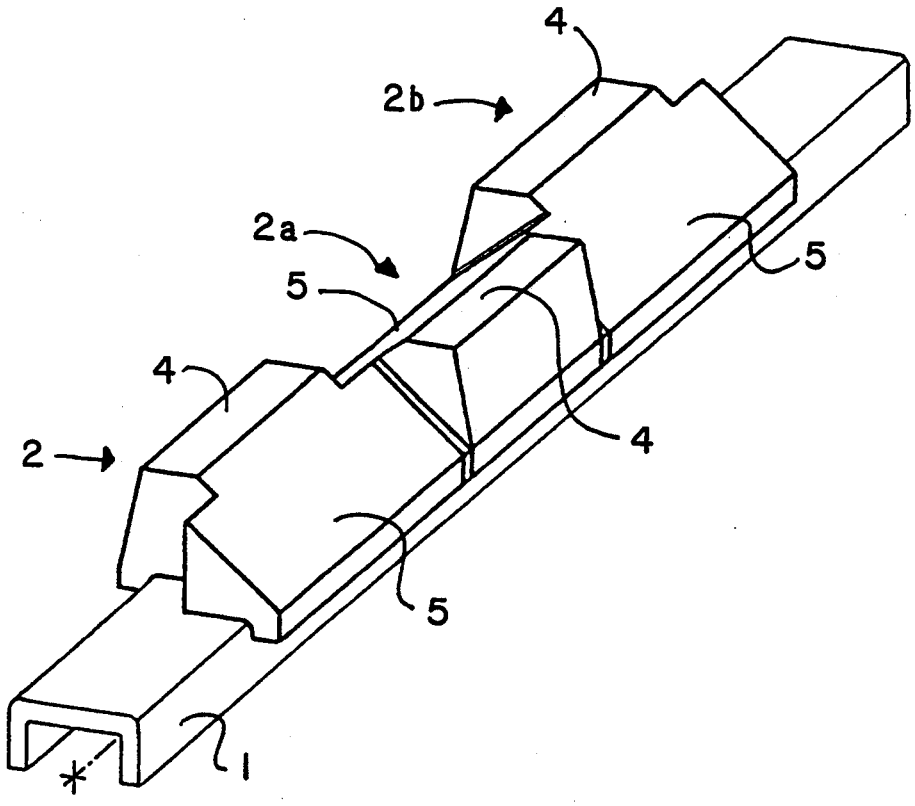
FIG. 4A is a perspective view of a skid pipe in an operational state including three riders alternatively arranged on the skid pipe.
Figure 4B:
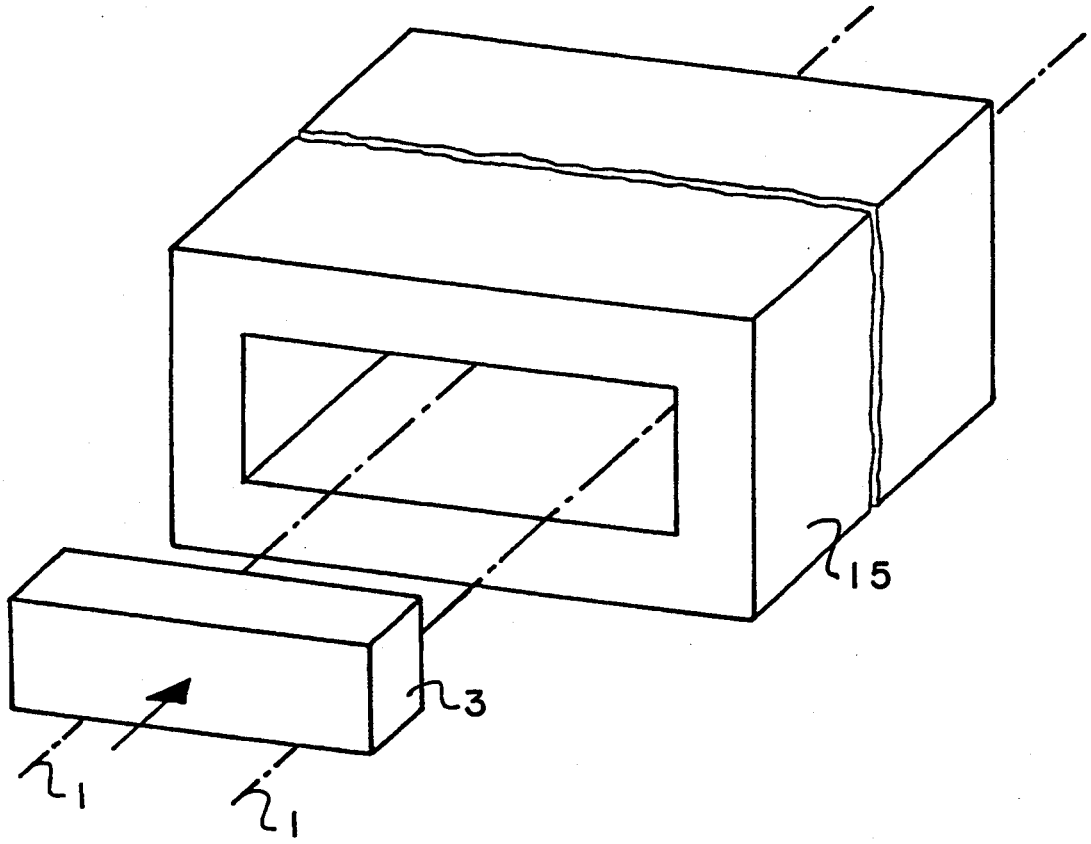
FIG. 4B is a perspective view of a furnace and a charge being positioned for insertion into a furnace through a pair of skid pipes as shown in FIG. 4A.
Figure 4C:
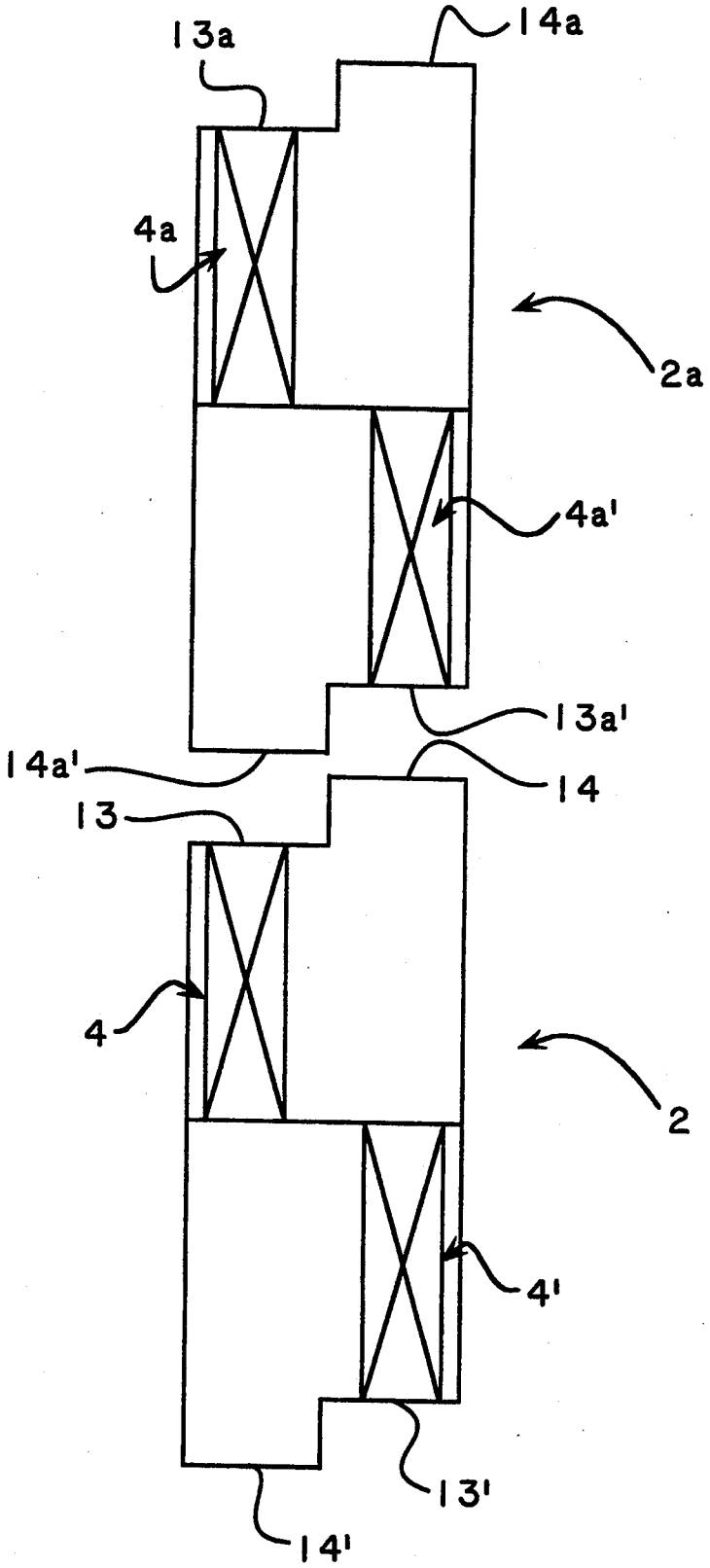
FIG. 4C is a top plan view of two riders.

In the embodiments of the present invention depicted in FIGS. 2 and 3, the sides of the rider faces opposite the charge carrying surface (4) are provided with protrusions (13) substantially over half the face width, recesses (14) recognizable in FIG. 3 thereby being formed on the rider face sides underneath the charge carrying surface (4). Each protrusion (14) penetrates into recess (13*a*) of the neighboring rider (2*a*).

Said interpenetration of the riders (2 and 2*a*) being exposed to forces acting in the counterclockwise and in the clockwise senses respectively interlock said riders and thereby prevents said riders from being turned off said skid pipe.

FIG. 3 is a partial top view of two complete riders (2 and 2*a*). Gaps (15) filled with ceramic fiber material or the like are provided between said two riders to accommodate thermal expansion.

It is apparent to any person versed in the art that further embodiments of the present invention may be devised. A rider may be provided with more than one (for example two) charge carrying surfaces arranged in a staggered row behind each other. Further, the skid pipe cross-section may be round or rectangular.

What we claim is:

1. A device for carrying a charge and more particularly slabs, billets, ingots and the like in a furnace, said device comprising:

at least one skid pipe defining a centerline running in a longitudinal direction, said skid pipe being capable of carrying a cooling fluid flowing through said skid pipe;

at least two riders capable of withstanding an elevated temperature arranged on said skid pipe, each of said at least two riders including a plurality of carrying surfaces capable of supporting said charge and running off-center and substantially parallel to said centerline in said longitudinal direction so as to extend around an upper part of the skid pipe, said plurality of carrying surfaces being laterally spaced relative to each other and running at least partially to a side of said skid pipe, a plurality of roof-shaped surfaces laterally adjacent to said plurality of carrying surfaces of each of said at least two riders, and each of said at least two riders also having two face ends, each said face end having a first part adjacent to one of said plurality of carrying surfaces and said second part adjacent to one of said plurality of roof-shaped surfaces, wherein said second part of a first of said at least two riders protrudes relative to the first part of a second of said at least two riders in said longitudinal direction, the protruding second part also being disposed opposite to the first part of the second rider; and at least two tilt stopping means connected with said skid pipe at least one of said riders extending below the top surface of said skid pipe and resting on said tilt stopping means so that at least one of said tilt stopping means is underneath each carrying surface.

2. The device according to claim 1 wherein at least one of said riders is provided with a surface inclined in a direction transverse to said longitudinal direction to one side of each carrying surface and each such inclined surface is provided with a cut-out in which a ceramic component is arranged.

3. The device according to claim 1 wherein said riders are steel castings fit for elevated temperature service.

4. A device for carrying a charge and more particularly slabs, billets, ingots and the like in a furnace, said device comprising:

a skid pipe defining a centerline running in a longitudinal direction, said skip pipe being capable of carrying a cooling fluid flowing through said skid pipe; and at least two riders capable of withstanding an elevated temperature arranged on said skid pipe, each of said at least two riders including:

at least one carrying surface capable of supporting said charge and running substantially parallel to said centerline defined by said skid pipe and off-center from said centerline so as to extend around an upper part of said skid pipe, and a surface laterally adjacent to said carrying surface, said surface including a first protruding part and a second protruding part, where both said first protruding part and said second protruding part extend in a longitudinal direction from said charge carrying surface such that said second protruding part of a first rider of said at least two riders is disposed opposite to said first protruding part of a second rider of said at least two riders in an interlocked state, neighboring carrying surfaces being laterally spaced relative to each other and running at least partially to a side of said skip pipe.

5. The device according to claim 4, wherein said at least one carrying surface of each rider being laterally spaced relative to each other and running at least partially to a side of said skid pipe.

6. The device according to claim 4 wherein each rider has two face ends, each face end consisting of a first part on the side of said carrying surface and a second part, said second part protruding in said longitudinal direction from said first part, said protruding second part of the face end of one of a series of riders being opposite to the first part of the face end of the neighboring rider.

7. The device according to claim 4 wherein at least one tilt stopping means connected with said skid pipe is provided and wherein at least one of said riders extends below the top surface of said skid pipe to rest on said tilt stopping means with its carrying surface above said tilt stopping means.

8. The device according to claim 4 wherein at least one of said riders is provided with a surface inclined in a direction transverse to said longitudinal direction to one side of said carrying surface.

9. The device according to claim 8 wherein said inclined surface is provided with a cut-out in which a ceramic component is arranged.

10. The device according to claim 4 wherein at least one of said riders is provided with a surface inclined in said longitudinal direction to one side of said carrying surface.

11. The device according to claim 10 wherein said inclined surface is provided with a cut-out in which a ceramic component is arranged.

12. The device according to claim 4 wherein at least one of said riders is provided with a surface inclined in said longitudinal direction and in a direction transverse to said longitudinal direction to one side of said carrying surface.

13. The device according to claim 12 wherein said inclined surface is provided with a cut-out in which a ceramic component is arranged.

14. The device according to claim 4 wherein said skid pipe is provided with a fitting protruding upwardly into a recess in one of said riders, a bolt transverse to said longitudinal direction passing through said rider and said fitting.

15. The device according to claim 4 wherein said riders are steel castings capable of withstanding an elevated temperature.

* * * * *